US005188162A

United States Patent [19]

Simon et al.

[11] Patent Number: 5,188,162

[45] Date of Patent: Feb. 23, 1993

[54] MINI BLIND SYSTEM AND VALANCE ASSEMBLY THEREFOR

[75] Inventors: Terry L. Simon, South Bend, Ind.; Gordon R. Erickson, Freeport, Ill.

[73] Assignee: Newell Operating Company, Freeport, Ill.

[21] Appl. No.: 810,643

[22] Filed: Dec. 18, 1991

[51] Int. Cl.[5] ..... E06B 9/26

[52] U.S. Cl. ..... 160/166.1; 160/38; 160/902

[58] Field of Search ..... 160/19, 38, 39, 178.1, 160/166.1, 902; 248/264

[56] References Cited

U.S. PATENT DOCUMENTS

| | | | |
|---|---|---|---|
| 2,670,167 | 2/1954 | Nelson | 248/264 |
| 2,792,999 | 5/1957 | Lorentzen | 248/264 |
| 2,916,246 | 12/1959 | Radel | 248/264 |
| 4,177,853 | 12/1979 | Anderson et al. | 160/178.1 X |
| 4,384,605 | 5/1983 | Schaeffer et al. | 160/19 X |
| 4,828,002 | 5/1989 | Ashby | 160/38 |
| 4,840,216 | 6/1989 | John | 160/38 X |
| 4,921,031 | 5/1990 | Wagner et al. | 160/38 |
| 4,957,255 | 9/1990 | John | 160/902 X |
| 5,054,535 | 10/1991 | Rozon | 160/38 |

*Primary Examiner*—David M. Purol
*Attorney, Agent, or Firm*—Baker & McKenzie

[57] ABSTRACT

A valance assembly for a mini blind and a mini blind which includes a valance, the apparatus including end brackets which support a mini blind by engagement with the head rail of the head rail assembly of the mini blind and in which the end brackets carry slots for the receipt of upper and lower lips on a valance which can be cut to any desired length, the valance, once engaged with the end brackets, providing a continuous, uninterrupted surface to the viewer. In addition, a clip engagable with the head rail and located behind the valance secures the valance to the head rail so as to form a unit whereby sag between the head rail and the valance is precluded.

11 Claims, 2 Drawing Sheets

MINI BLIND SYSTEM AND VALANCE ASSEMBLY THEREFOR

This invention relates generally to that type of window coverings now commonly referred to, in North America, as a blind, and specifically to a mini blind system and a valance assembly for a mini blind system.

BACKGROUND OF THE INVENTION

The window covering system known as a mini blind has become increasingly popular with home owners, and others, such as occupants of business offices, in recent years. A typical mini blind includes a plurality of individual slats, often about one inch in width and formed of either metal or plastic, a head rail assembly from which the slats are suspended, the head rail assembly containing part of the mechanism for raising and lowering the blind, and a bottom rail, one of whose purposes, in addition to providing a pleasing aesthetic appearance, is to form an anchoring base for the blind raising and lowering, and tilting, mechanisms.

Two problems which are common to all such blinds are (1) ensuring that the head rail is securely maintained in place, and particularly that it not tend to move forwardly under the stresses encountered in use and (2) ensuring that the upper end of the blind, and particularly the head rail, presents a pleasing and decorative appearance to the eye of the viewer. Valance systems intended to cover the head rail and upper parts of a mini blind have been developed but none are deemed totally satisfactory. Specifically, many valance systems require a secondary stop or some action to restrict the head rail to its intended placement after installation. Further, many valances are of fixed length and hence are not adaptable to the new type of mini blind which is cut to a customer's exact specification in a store, and thus the desired aesthetic appearance is not achieved. Further, in some current systems, clips or brackets are exposed to the eye of the viewer at the conclusion of installation which again detracts from the desired aesthetic appearance.

SUMMARY OF THE INVENTION

The invention comprises a mini blind system having, as a component thereof, a unique valance system and, in another aspect, the unique valance system per se. The valance system includes a pair of supporting brackets which are easily installable by even an inexperienced person, such as a home dweller, who does such a task only rarely. In this regard the supporting brackets are easily installed on outside mounting surfaces, such as the vertical top header of a window frame, or on inside surfaces, such as the inside of a window frame. The supporting brackets further include means for maintaining the head rail assembly of a mini blind locked into position at the end of installation by a restraining rib inside the bracket whereby any tendency for the head rail assembly to move forwardly during use, or in response to shocks or jars, is positively precluded, this advantage being obtained without the use of additional clips or auxiliary brackets at or near the supporting brackets. After installation of the supporting brackets and placement of the head rail assembly of a mini blind in the brackets, and locking the head rail assembly with respect to the supporting brackets, an aesthetically pleasing valance, which may be easily sized to the exact length required, is quickly, easily and simply snapped in place to provide a pleasant finished appearance. And further, the invention includes clip means carried by the head rail which positively engages the valance so that sag between the valance and the head rail assembly, especially in long spans, is precluded. The clip means is carried by the head rail assembly and in turn fixably secured to the valance so that the valance and head rail are secured to one another as a unit thereby, to some extent, mutually rigidifying each other and thus reducing or eliminating sag of either or both.

DESCRIPTION OF THE DRAWING

The invention is illustrated more or less diagrammatically in the accompanying drawing wherein.

DETAILED DESCRIPTION OF THE INVENTION

Figure 1:
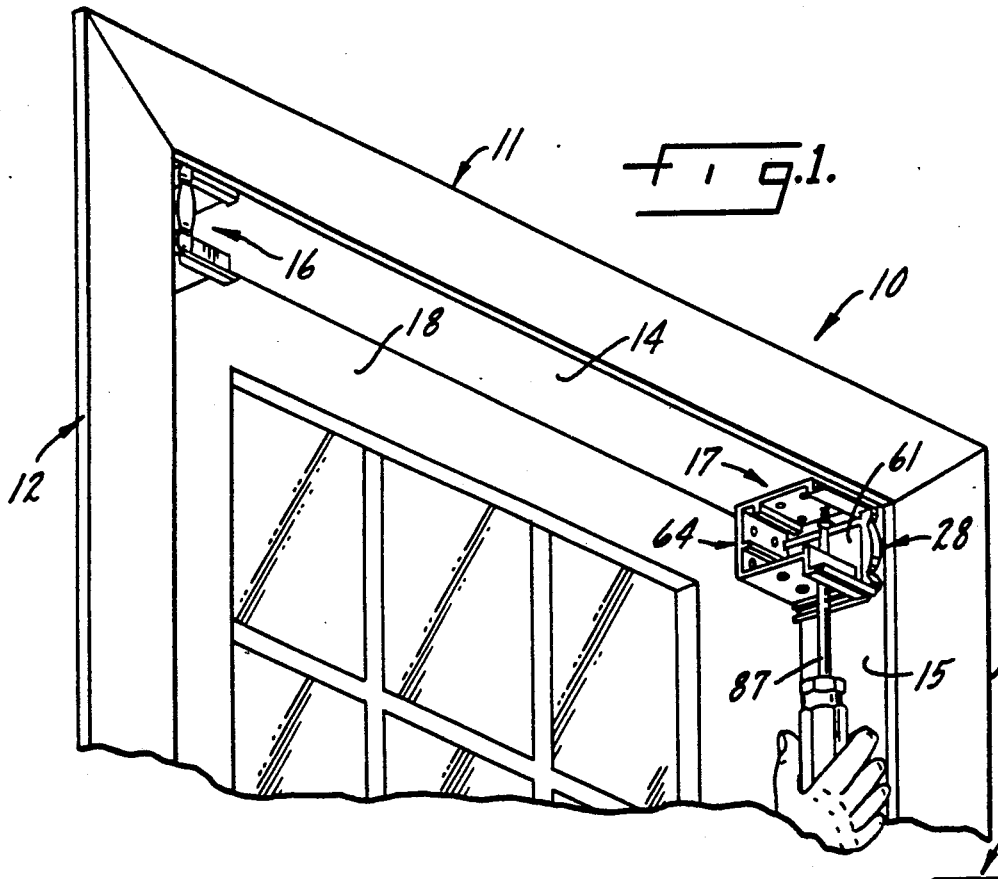
FIG. 1 is perspective view showing a step in the installation of a support bracket, here the right support bracket in a pair of brackets, into an inside window mount.

Like reference numerals will be used to refer to like parts from Figure to Figure in the drawing.

In FIG. 1 a portion of a window frame in which the second of two mini blind head rail and valance supporting brackets is being installed is indicated generally at 10. The window frame includes a header, indicated generally at 11, left side frame, indicated generally at 12, and right side frame, indicated generally at 13. The header 11 includes an inside header panel 14 which meets, at its right side, with the upper end of an inside right frame panel 15 and, at its left end, with an inside left frame panel, not shown, of left side frame 12. As seen in FIG. 1, a left supporting bracket 16 has already been installed as an inside mounting in the corner formed where the left end of inside header panel 14 meets the top of the inside left frame panel, and right supporting bracket 17 is in the process of being installed in the corner formed where the right end of inside header panel 14 meets the upper end of the right frame panel 15. It will be understood that the upper frame member 18 of the window should not be secured to the support bracket 17 since the window must be free to slide up and down.

Figure 2:
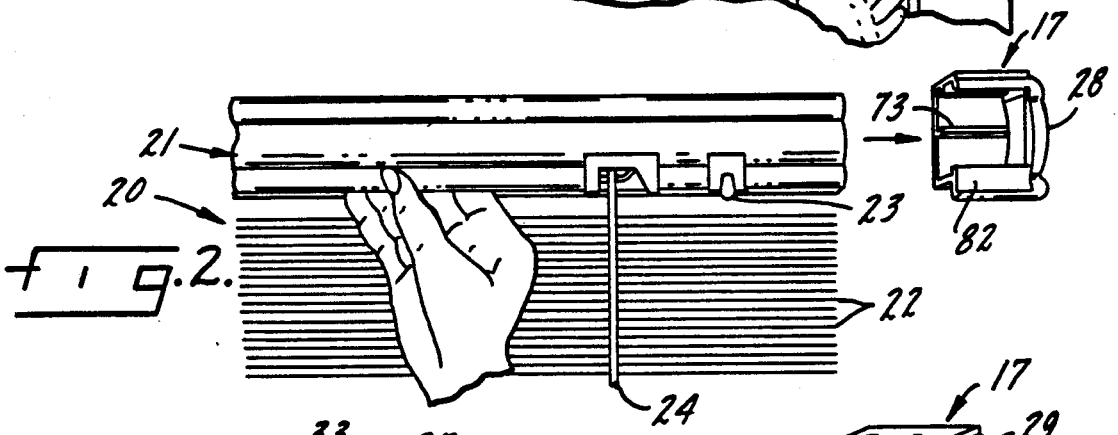
FIG. 2 is a view illustrating the installation of a head rail assembly of a mini blind into a right support bracket of the valance system of this invention.

In FIG. 2 the right supporting bracket 17 is shown isolated in space in the position it occupies after installation in a window frame 10. A mini blind, indicated generally at 20, includes a head rail assembly, indicated generally at 21, from which a plurality of individual slats 22 which form the mini blind depend. A portion of a slat tilting mechanism is indicated at 23 and a portion of the slat extending and retracting system is indicated at 24. An installer, such as a home dweller, is in the process of sliding the right end of the head rail assembly 21 into the already installed right supporting bracket 17 as indicated by the arrow.

Figure 3:
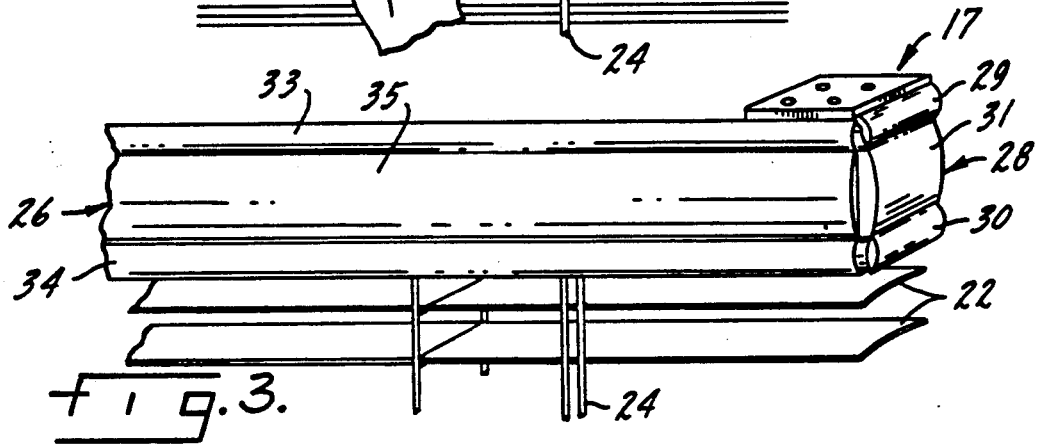
FIG. 3 is a partial perspective view showing a valance secured to the right support bracket of the valance assembly following the insertion of the head rail assembly into said right bracket.
Figure 10:
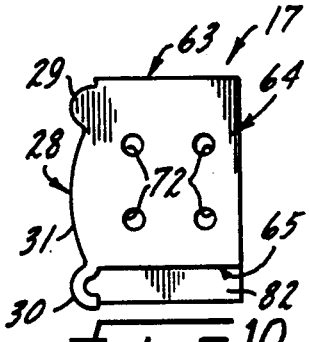
FIG. 10 is an elevation of the rear surface of the rear wall of the right support bracket of the valance assembly of FIG. 1.
Figure 13:
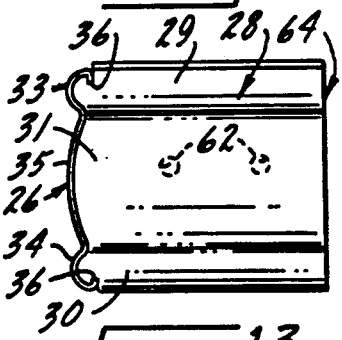
FIG. 13 is an elevation of the outside of the right wall of the right supporting bracket of the valance assembly of FIG. 1.

In FIG. 3 the head rail assembly 21 has been slid into seating contact with right supporting bracket 17 and a valance, indicated generally at 26, has been snapped into place onto the front of right supporting bracket 17 as will be described in detail hereinafter. It will be noted that the outside surface of the right side wall 28 of the supporting bracket 17 has been formed with an upper narrow bead 29 and a lower narrow bead 30 which flank a larger, central bulged portion 31, with the beads and central portion, in this instance, blending into each other in an aesthetically pleasing manner as seen better in FIGS. 8, 10 and 13 The Valance 26 has an upper bead 33, lower bead 34 and central bulged portion 35 which are of the same shape and vertical dimension as the beads and central portion on right side 28 of the bracket 17 so that the junction where the right end of valance 21 meets the outer edge of right side 28 given the impression, to the eye, of a common external contour on both the valance 26 and the bracket 17. The beads 33, 34 each terminate in a lip 36, tho lips being directed toward the center of the valance all as best seen in FIGS. 5 and 13.

Figure 4:
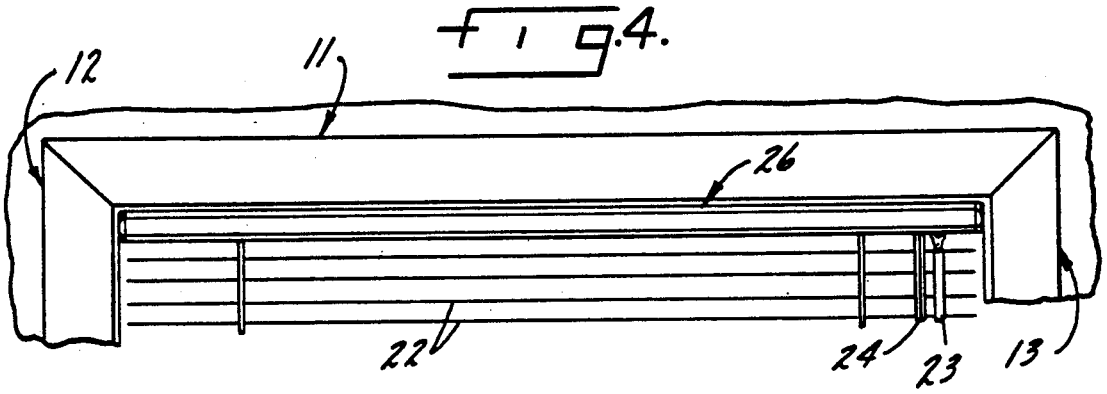
FIG. 4 is a front elevation of the mini blind system including the valance assembly of this invention in an installed condition.

From FIG. 4 it will be seen that when the valance 26 is slipped into place on the left and right brackets, a straight, that is, non-sagging, uninterrupted appearance is presented to the eye of the observer The supporting brackets, including one or more clips for supporting the head rail intermediate its ends, which make possible the smooth, straight interrupted appearance in FIG. 4, are illustrated in detail in FIGS. 6 through 13.

Figure 6:
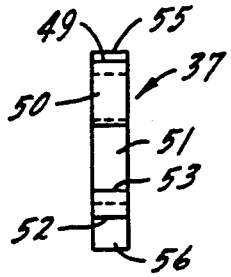
FIG. 6 is a rear view of the valance clip depicted in FIG. 5.
Figure 5:
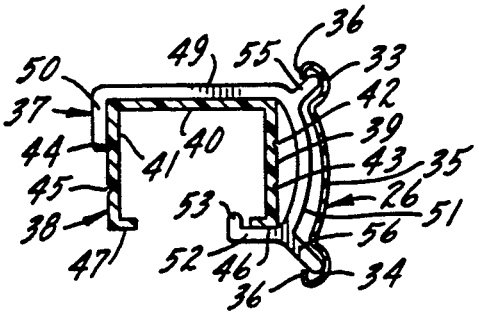
FIG. 5 is a section through the head rail and valance on the left side of a valance clip located, by way of illustration, at the center of the head rail assembly in FIG. 4.
Figure 7:
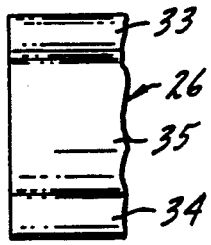
FIG. 7 is a front elevation of the left end of a valance.

Referring first to FIGS. 5, 6 and 7, and initially to FIGS. 5 and 6, an intermediate support bracket or clip is indicated generally at 37. In FIG. 5, which is a view through the head rail taken at a location to the left of the clip and looking toward the right end of the mini blind system, the head rail housing is indicated at 38. Housing 38 includes a front wall 39, a top wall 40, and a rear wall 41. Front wall 39 has two spaced, parallel grooves 42, 43, which preferably extend its entire length for ease of molding, and two similar rear wall grooves, an upper one indicated at 44 and a lower one at 45. An internal flange is indicated at 46 at the lower end of front wall 39 and an oppositely disposed internal flange is indicated at 47 at the lower end of rear wall 44, the flanges being directed toward one another. It will be understood that the upper most end of the downwardly depending slat means together with tilting and extending and retracting mechanisms are located in the interior of the head rail housing 38, but have been omitted for clarity.

Clip 37 consists of a top wall 49, a rear wall 50 which, as best seen in FIG. 5, extends downwardly from top wall 49 only a portion of the vertical heights of the rear wall 41 of the head rail, and a front wall 51. The front wall 51 is preferably bowed or bulged outwardly slightly for strength purposes and, also, to help indicate to the eye of a user how the valance 26 should be installed. A supporting flange 52 extends toward the rear of the housing 38 from the bottom edge of front wall 39, the flange 52 providing a support base on which front wall flange 46 of the head rail housing rests The inner end of the housing supporting flange 52 preferably terminates in an upturned lip 53 which forms an abutment to flange 46, and hence a stop means which precludes disassembly of the head rail housing from the clip, and visa versa.

Rear wall 50 of the clip terminates in an inwardly directed tip or projection which is of a size suitable to be received in the rear wall top groove 44, the engagement of the projection, which preferably extends the width of clip 37, acting in conjunction with the loose restrainment of the clip by the lip 53, to lock the clip 37 to the head rail housing 38.

A pair projections 55, 56 extend generally radially outwardly from the center of the head rail housing near the junction of the top and front walls 49, 51, and also the junction of the front wall 51 and supporting flange 52 of the clip. The upper end of bead 33 of valance 26 is curved downwardly and the lower end of bead 34 is curved upwardly to form pockets within the beads 33 and 34 which receive, respectively, the upper clip projection 55 and the lower clip projection 56 to thereby secure the valance 26 to the head rail housing 38. Since the head rail assembly, including the housing 38, has substantial structural rigidity, it will be seen that the straightness of the head rail assembly in its installed position will be imparted to the valance 26, and hence, to the eye of the observer, there is no sag in valance 26.

The right supporting bracket 17 which the user is seen to be in the last stages of installing in FIG. 4, is illustrated best in FIGS. 8 through 13.

Figure 8:
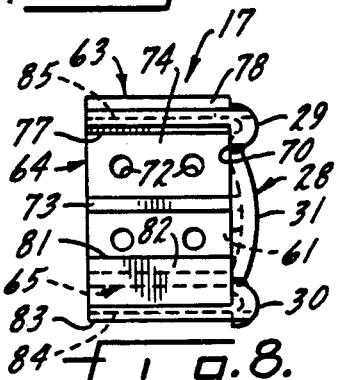
FIG. 8 is a front elevation of the inside of the rear wall of the right supporting bracket of the valance assembly of FIG. 1.
Figure 9:
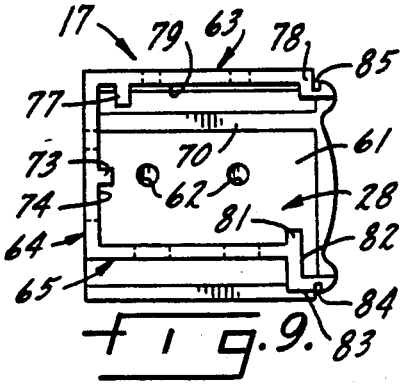
FIG. 9 is an elevation of the inside of the right wall of the right support bracket of the valance assembly of FIG. 1.

Referring first to FIGS. 1, 8 and 9, the right side wall of right supporting bracket is indicated generally at 28 and the inside surface of the right side wall is indicated at 61. A pair of recesses are indicated at 62 which extend into, but not all the way through, the right side wall 28 to accommodate a pair of screws in the event it is most convenient to secure the right supporting bracket by its right side to a base surface. Such a securement option is possible in the FIG. 1 environment, but probably not the most convenient for the user. The top wall is indicated generally at 63, the rear wall is indicated generally at 64, and the bottom wall is indicated generally at 65.

In this instance the outer surface of right side wall 28 is formed with an upper bead 29, a lower bead 30, and a central bulged portion 31, the beads and central bulged portions being of the same configuration as the beads 33, 34 and central bulged portion 35 of the valance 26. Bead 29 has a reflected, inwardly extending bead 70 on inside surface 61, as best seen in FIG. 9.

Rear wall 64 has four screw holes therein, indicated at 72, for the purpose of installation in the appropriate environment. Such a securement option is possible in the FIG. 1 environment, but probably not the most convenient for the user. Such a securement option will be, however, the main or probably only feasible securement option in an outside mounting, as would be the case if the right supporting bracket 17 were to be mounted on the header 11. A spacer bar is indicated at 73 for the purpose of spacing the head rail housing 38 away from the inside surface 74 of the rear wall 64 to accommodate the thickness of screw heads if screw holes 72 are used.

A plurality of screw holes 76 are provided in top wall 63 for installation in an appropriate environment, such as the inside mounting illustrated in FIG. 1. It is likely that this will be the preferred mounting arrangement for inside mounts since the installer need not climb as high on a ladder to do the installation, or not need a ladder at all, depending of course on the height of the window, as contrasted to the use of holes 72 for an outside mount. A rear spacer bar is indicated at 77 and a front spacer member at 78 for the purpose of spacing the head rail housing 38 away from the inside surface 79 of the top wall to accommodate the thickness of screw heads if screw holes 76 are used. It will be understood that when the head rail assembly 21 is slid into the supporting bracket, the outside surface of the head rail housing 38 will slide smoothly along spacer bars 73 and 77 and spacer member 78 and not be blocked momentarily by the securing screw heads, a condition which would require dexterous manipulation by the installer to move past the momentary obstruction provided by the screw heads. Bottom 65 terminates at its outward edge in an upwardly extending flange 81. The front edge of a downwardly extending flange is indicated at 82, flange 82 in turn terminating in an outwardly projecting lip 83 which, as best seen in FIGS. 9 and 13, has a groove 84 for receiving the bottom, in-turned lip edge of valance 26. Bottom wall 65 also has four tool openings therein two of which are indicated at 86, which are vertically aligned with the top wall screw holes 76. The purpose of the tool openings is to accommodate a tool, such as the head and shank of a screwdriver, indicated at 87 in FIG. 1, which is used to screw securement screws into the inside header panel 14.

Figure 11:
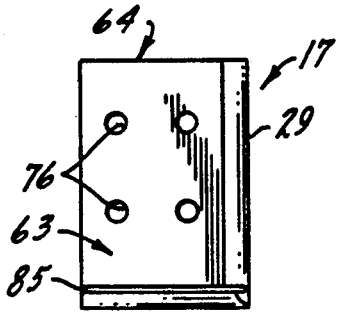
FIG. 11 is a top plan view of the top side of the top wall of the right supporting bracket of the valance assembly of FIG. 1.
Figure 12:
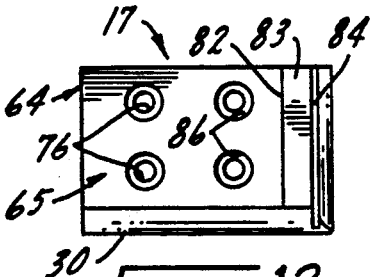
FIG. 12 is a bottom plan view of the bottom surface of the bottom wall of the right supporting bracket of the valance assembly of FIG. 1.

From the foregoing description, it will be seen that a user has the option of installing a mini blind system on an inside FIGS. 1 and 11, a second set of holes 72 as illustrated in FIG. 8 or a third set of screw holes 62 illustrated in FIG. 9, or, alternatively, as an outside mount using, most likely, screw holes 72.

With an inside mount, which will usually utilize screw holes 76, easy access is provided for a screwdriver or other tool and the user can remain at the most comfortable installation position, and possibly even stand on the floor. Even if screw holes 62 or 72 are used, easy access is provided for the screwdriver and clear view lines for the user result from the open center configuration of the bracket.

After the bracket is in place, the user simply slides the head rail housing 38 of the head rail assembly 21 into the fixed, now stationary bracket as indicated in FIG. 2, the end of housing 38 being guided by spacer bars 73 and 77, spacer member 78 and flange 81 into a positively, nested position, the spacer bars 73 and 77 and spacer member 78 precluding the possibility of the housing hanging up on the screw heads of the screws in holes 72 or 76.

After the head rail assembly has been anchored in place in the left and right supporting brackets 16 and 17, an intermediate support clip 37 is snapped over the head rail housing 38. The inwardly projecting tip at the lower end of rear wall 50 of the clip 37 seats, in this instance, in the top groove 44 in rear wall 41 of the housing assembly. At the same time, lower supporting flange 52 and its upturned lip 53 slides over the inturned flange 46 in the bottom of front wall 39 of the head rail housing and snaps into the FIG. 5 position wherein the upturned lip 53 of supporting flange 52 is located inwardly of in-turned flange 46 and hence outward movement of the lower end of the clip with respect to the head rail housing is precluded. It will be understood, of course, that if, for any reason, the user, after placing the clip 37 on the head rail housing at one location wishes to move the clip to a different location, the clip can easily be slid along the housing. Specifically, squeezing forces may be applied by the thumb and finger of a user on the upper and lower clip projections 55 and 56 to thereby lower the tip of lip 53 beneath the bottom of in-turned flange 46 to thereby clear the clip from the housing preparatory to installation at another location.

After the head rail assembly 21 has been slid into place and the clip or clips 37 secured to the head rail housing 38, a flexible valance 26 is snapped into place on the clip or clips turned and upturned lips 36 of the valance 26 being initially expanded and thereafter snapped into place in lower and upper grooves 84, 85 of the left and right supporting brackets. Those locations on the valance 26 which butt against each clip 37 are secured in like manner, the lips 36 of the valance being initially expanded due to the spring characteristics of the metal or plastic material of which the valance is made, and thereafter snapped into place over the upper and lower clip projections 55 and 56 as indicated in FIG. 5. When in place, the external contour of the valance 26 matches the external contour of the outside walls 28 of the support brackets, and the corner junctions of the valance and the brackets match, thereby creating a continuous pleasing aesthetic appearance.

The head rail assembly 21 is securely maintained in place by the spacer bars 73 and 77 and spacer member 78 and any tendency for the head rail assembly to move forwardly under forces encountered during use is countered, particularly by flange 81 which precludes outward movement of the head rail assembly. No additional or secondary parts are required to hold the head rail assembly to the brackets.

All tendency for the valance to sag relative to the head rail assembly and thereby present a disturbing symmetrical or unsymmetrical gap between the valance and the head rail is eliminated by the clip or clips 37 which fix the valance 26 to the head rail assembly 21 so that the much greater inherent rigidity of the head rail assembly is imparted to the valance 26 and thus the valance and head rail assembly become, in effect, a single unitary structure which reinforce one another.

In addition, the clip and bracket system is easily adapted for use with any length head rail assembly. Since the valance is made of thin metal or, preferably, plastic, it may be readily cut to the proper length by a pair of scissors after the supporting brackets have been installed and after the head rail assembly has been anchored in place in the supporting brackets.

And finally, once assembled, no securement system components are exposed to view so that an eye pleasing appearance is always presented to the beholder.

Although a specific embodiment of the invention has been illustrated and described, it will at once be apparent to those skilled in the art that modifications may be made within the spirit and scope of the invention. Accordingly, it is intended that the scope of the invention be limited not by the foregoing exemplary description, but solely by the scope of the hereafter appended claims when interpreted in light of the relevant prior art.

We claim:

1. A mini blind system, said mini blind system comprising:

a mini blind having a head rail assembly, first and second head rail assembly supporting means for supporting the mini blind in a fixed position which precludes displacement of the mini blind from said fixed position under the displacing forces encountered in the operation of said mini blind, each of said first and second head rail assembly supporting means including a bracket assembly having top wall means, rear wall means and a head rail assembly supporting means beneath and vertically spaced from the top wall means, the head rail assembly supporting means being a bottom wall means, means for securing the bracket assembly to a base structure associated with at least one of the top or rear wall means, means for spacing the head rail assembly away from at least one of the top or rear wall means by which the bracket assembly is secured to a base structure, means for precluding the head rail assembly, when supported in alignment with the top and rear wall means, from moving outwardly away from the rear wall means under the impact of forces encountered during use of the mini blind, said means for precluding the head rail assembly from moving outwardly from the rear wall means includes abutment means carried by an outer end portion of the bottom wall means and an outer end portion of the top wall means.

2. The mini blind system of claim 1 further characterized in that each of the rear and top wall means includes the means for spacing the head rail assembly away from an adjacent top or rear wall means.

3. The mini blind system of claim 1 further including outside wall means, said outside wall means also having means for securing the bracket assembly to a base structure.

4. The mini blind system of claim 3 further including means for spacing the head rail assembly away from the outside wall means by which the bracket assembly is secured to a base structure.

5. The mini blind system of claim 4 further characterized in that each of the rear and top wall means includes the means for spacing the head rail assembly away from the adjacent wall means.

6. A valance assembly for a mini blind, said valance assembly including two bracket assemblies, each bracket assembly accommodating an end of a head rail means, each bracket assembly having top wall means and bottom wall means, first valance receiving means in an outer end portion of the top wall means and second valance receiving means in an outer end portion of the bottom wall means whereby each bracket assembly provides two spaced support locations for a valance to be secured thereto, said support locations being arranged so that each bracket assembly is blocked from view when a valance is secured to said bracket assembly.

7. A mini blind system, the mini blind system comprising:

a mini blind having a head rail assembly, and first and second head rail assembly supporting means for supporting the mini blind in a fixed position which precludes displacement of the mini blind from the fixed position under the displacing forces encountered in the operation of the mini blind, each of the first and second head rail assembly supporting means including a bracket assembly having top wall means, rear wall means and a bottom wall means, the bottom wall means supporting the head rail assembly, the bottom wall means being disposed beneath and vertically spaced from the top wall means, means for securing the bracket assembly to a base structure associated with at least one of the top or rear wall means, and means for precluding the head rail assembly, when supported in alignment with the top and rear wall means, from moving outwardly away from the rear wall means under the impact of forces encountered during use of the mini blind, the means for precluding the head rail assembly from moving outwardly from the rear wall means includes abutment means carried by the bottom wall means at an outer end portion thereof, first valance receiving means in an outer end portion of the top wall means, and second valance receiving means in the outer end portion of the bottom wall means, whereby the bracket assembly provides two spaced support locations for a valance to be secured thereby, the support locations being arranged so that the bracket assembly is blocked from view when a valance is secured to the bracket assembly.

8. The mini blind system of claim 7 further including clip means, the clip means having rear, top, front and bottom portions, the rear portion being arranged to engage a rear of a head rail assembly housing, the bottom portion being arranged to engage a lower end portion of a front wall of a head rail housing of the head rail assembly, the clip means further including means for securing the clip means to a valance at two spaced locations on the clip means whereby the clip means, when in engagement with a valance, is blocked from view by the valance.

9. The mini blind system of claim 8 further including a valance.

10. A valance assembly for a mini blind, the valance assembly including two bracket assemblies, each bracket assembly having top wall means and bottom wall means, first valance receiving means in an the outer end portion of the top wall means, second valance receiving means in an the outer end portion of the bottom wall means, whereby the bracket assemblies providing two spaced support locations for a valance to be secured thereto, the support locations being arranged so that the bracket assemblies are blocked from view when a valance is secured to the bracket assembly, clip means, the clip means having rear, top, front and bottom portions, the rear portion being arranged to engage a rear of a head rail assembly housing, the bottom portion being arranged to engage a lower end portion of a front wall of a head rail housing of the head rail assembly, the clip means further including means for securing the clip means to a valance at two spaced locations on the clip means whereby the clip means, when in engagement with a valance, is blocked form view by the valance.

11. The valance assembly of claim 10 further including a valance.

* * * * *